US007409780B2

(12) United States Patent
Marvin et al.

(10) Patent No.: US 7,409,780 B2
(45) Date of Patent: Aug. 12, 2008

(54) BELLOWED CHAMBER FOR A SHOE

(75) Inventors: William Marvin, Brighton, MA (US); Geoff Swales, Somerset, MA (US)

(73) Assignee: Reebok International Ltd., Canton, MA (US)

( * ) Notice: Subject to any disclaimer, the term of this patent is extended or adjusted under 35 U.S.C. 154(b) by 471 days.

(21) Appl. No.: 10/895,143

(22) Filed: Jul. 21, 2004

(65) Prior Publication Data

US 2005/0016021 A1 Jan. 27, 2005

Related U.S. Application Data

(60) Provisional application No. 60/488,389, filed on Jul. 21, 2003.

(51) Int. Cl.
*A43B 13/20* (2006.01)
*A43B 7/06* (2006.01)

(52) U.S. Cl. ..... 36/29; 36/28; 36/3 B

(58) Field of Classification Search ..... 36/28, 36/29, 35 B, 3 B, 3 R, 97, 3 A
See application file for complete search history.

(56) References Cited

U.S. PATENT DOCUMENTS 2,379,416 A * 7/1945 Clark ..... 5/413 R
2,458,602 A * 1/1949 Johnson ..... 280/611
4,091,482 A * 5/1978 Malcolm ..... 5/413 R
4,760,651 A 8/1988 Pon-Tzu
4,887,367 A 12/1989 Mackness et al.
4,918,838 A 4/1990 Chang
5,014,449 A 5/1991 Richard et al.
5,353,523 A 10/1994 Kilgore et al.
5,367,792 A 11/1994 Richard et al.
5,505,010 A * 4/1996 Fukuoka ..... 36/3 B
5,564,143 A 10/1996 Pekar et al.
5,621,984 A 4/1997 Hsieh
5,625,966 A 5/1997 Perotto et al.
5,655,315 A * 8/1997 Mershon ..... 36/97
5,987,779 A 11/1999 Litchfield et al.
6,287,225 B1 9/2001 Touhey et al.
6,519,873 B1 2/2003 Buttigieg
6,701,643 B2 3/2004 Geer et al.
6,725,573 B2 4/2004 Doyle
2004/0016144 A1 * 1/2004 Gallegos ..... 36/3 R

FOREIGN PATENT DOCUMENTS

FR 2563979 11/1985

* cited by examiner

*Primary Examiner*—Jila M Mohandesi
(74) *Attorney, Agent, or Firm*—Sterne, Kessler, Goldstein & Fox P.L.L.C.

(57) ABSTRACT

An inflatable cushioning device, and a process for making it, having a fluid-tight, enclosed area that is bordered by a first generally flat surface, a second generally flat surface and at least one bellowed surface, such that the bellowed surface will collapse when a force is applied. The cushioning device may include an inflation mechanism for selectively introducing air into the enclosed area. The cushioning device can be used in an athletic shoe.

20 Claims, 7 Drawing Sheets

BELLOWED CHAMBER FOR A SHOE

This application is a non-provisional application claiming priority to U.S. Patent Application No. 60/488,389 filed Jul. 21, 2003, the contents of which are incorporated herein in its entirety.

BACKGROUND OF THE INVENTION

1. Field of the Invention

This invention relates to cushioning devices for use in footwear, and to an article of footwear having a bellowed cushioning area.

2. Background Art

Athletic footwear must provide stable and comfortable support for the body while subject to various types of stress that occur during the various foot movements associated with athletic activity.

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain. Thus, it is essential to have cushioning footwear when engaging in athletic activity. Further, any cushioning system added to athletic shoes must be inexpensive and simple to use.

Proper footwear should complement the natural functionality of the foot, in part by incorporating a sole which absorbs shocks and returns energy to the foot. However, different levels of cushioning may be desired depending on the type of activity. Accordingly, it is desirable to provide a shoe which can provide a varying level of support and cushioning in the sole of the foot.

BRIEF SUMMARY OF THE INVENTION

The present invention resolves the above stated problems by providing an cushioning device comprising an air-tight, enclosed area defined by a first generally flat surface, a second generally flat surface and at least one bellowed surface. The bellowed surface collapses upon the force of the foot upon it to provides both cushioning and rebounding characteristics. In one embodiment, the cushioning device has an inflation mechanism for selectively introducing air into said enclosed area such that the level of support can be adjusted by the individual wearer. Further in one embodiment, the cushioning device is wedge-shaped with the first and second generally flat surfaces in close proximity at a first end and being separated by the bellowed surface at a second end.

The enclosed area is generally defined by an N number of sheets, including a first sheet, a second sheet, a third sheet, a fourth sheet and so on up to an Nth sheet. The first sheet is attached to the second sheet, the second sheet is attached to the third sheet, the third sheet is attached to the fourth sheet, and so on up to an Nth sheet. The first and Nth sheets are the first and second generally flat surfaces of the cushioning device while the intermediate sheets form the bellowed surface. In one embodiment, all but the first and Nth sheets are horseshoe shaped, such that the enclosed area is a single large cavity. In another embodiment, the enclosed area is made up of a plurality of chambers, wherein the first sheet and the second sheet form a first chamber, the third sheet and the forth sheet form a second chamber and so on. In this embodiment, a hole may be place in all but the first and Nth sheets such that each chamber is fluidly interconnected.

The sheets are formed from a fluid impermeable material, such as thermoplastic polyurethane.

The present invention contemplates an article of foot wear comprising a cushioning device comprising an enclosed area defined by a generally flat surface, a second generally flat surface and at least one bellowed surface.

The present invention also contemplates a process for manufacturing a bellowed cushioning device comprising providing four or more fluid impermeable sheets and attaching the sheets together to form a first generally flat surface, a second generally flat surface and a bellowed surface defining an fluid tight enclosed area.

BRIEF DESCRIPTION OF THE DRAWINGS/FIGURES

The foregoing and other features and advantages of the present invention will be apparent from the following, more particular description of a preferred embodiment of the invention, as illustrated in the accompanying drawings in which.

DETAILED DESCRIPTION OF THE INVENTION

Figure 1:
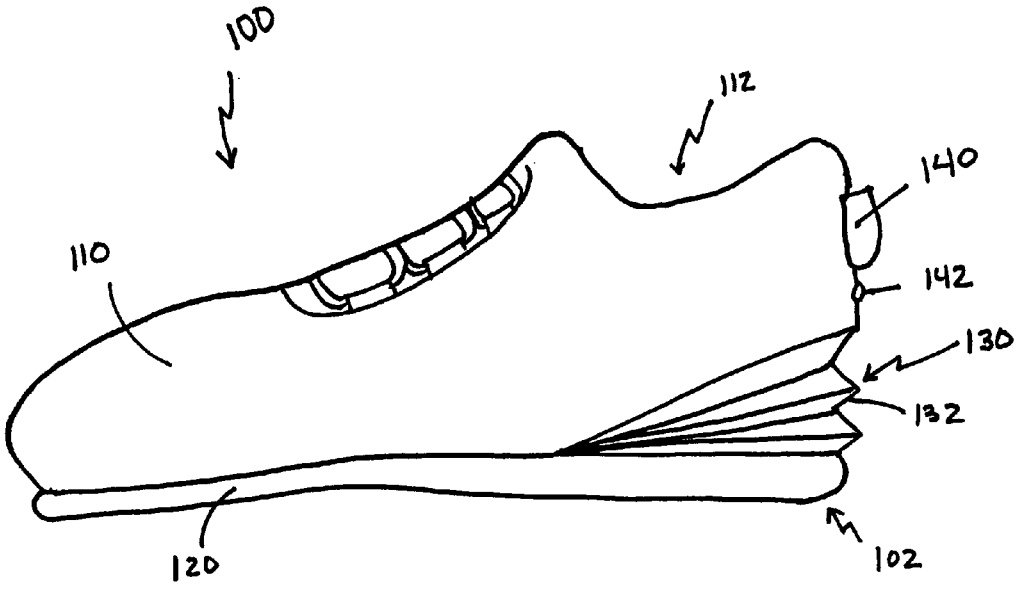
FIG. 1 is a side view of a shoe including an inflated cushioning device according to the present invention.

A preferred embodiment of the present invention is now described with reference to the Figures, in which like reference numerals are used to indicate identical or functionally similar elements. Also in the Figures, the left most digit of each reference numeral corresponds to the Figure in which the reference numeral is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in other applications.

A shoe for a left foot according to the present invention is shown generally at 100 in FIG. 1. A corresponding shoe for the right foot would be a mirror image of shoe 100 and therefore, is not shown or described herein. As shown in FIG. 1, shoe 100 has a heel area shown generally at 102, an upper 110, a sole 120, and a bellowed cushioning device 130. Upper 110 has an ankle opening shown generally at 112, which is designed to receive a wearer's foot.

It is preferred that the bellowed cushioning device 130 contain a fluid. Therefore, when pressure is placed on the bellowed cushioning device 130 the bellowed surface 132 collapses, forcing the fluid within into a smaller volume. The collapse of the bellowed surface 132 cushions the foot while the interior volume of fluid provides support for the foot. When the pressure on the bellowed cushioning device 130 is released, the bellowed surface 132 will rebound to its pre-collapsed shape and the fluid within will occupy the entire space.

The bellowed cushioning device 130 may be filled with any type of gas or liquid. Preferably, the bellowed cushioning device 130 contains air, since it is the most cost-effective fluid. Air may be contained in the bellowed cushioning device 130 at an ambient pressure or it may be pressurized. Preferably, the air within the bellowed cushioning device 130 is pressurized. The greater the pressure of the fluid in the bellowed cushioning device 130 the greater the volume that air occupies when compressed. Therefore, pressurized air will allow less collapse of the bellowed surface 132 than air at ambient pressure.

Figure 2:
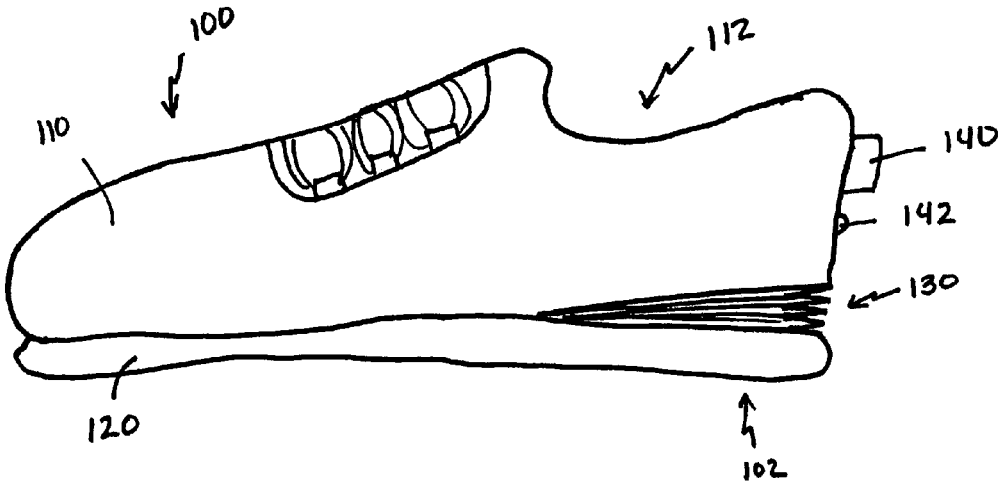
FIG. 2 is a side view of a shoe including a deflated cushioning device according to the present invention.

Air may be introduced into the bellowed cushioning device 130 at the time of manufacture or the device may include an inflation mechanism. Bellowed cushioning device 130 is shown inflated in FIG. 1, and is shown deflated in FIG. 2. The inflation mechanism 140 is a device which engages the bellowed cushioning device 130 through an external connection or valve. The inflation mechanism may be an external device such as a pump or a pressurized canister that is connected with bellowed cushioning device 130 when needed. Preferably, however, inflation mechanism 140 is a lightweight, on-board inflation system, as shown in FIGS. 1 and 2. An on-board inflation mechanism can be disposed on any area of the shoe provided it is in fluid communication with bellowed cushioning chamber 130, as would be apparent to one skilled in the art. Such places on the shoe include the tongue, the sole, the vamp or any other part of the upper. FIGS. 1 and 2 show the inflation mechanism 140 located in a rear portion of the upper. However, this embodiment is merely an example and is not intended to limit the scope of the application.

The preferred embodiment of FIG. 1 shows an inflation mechanism 140. The inflation mechanism 140 includes a one-way valve (not shown) to keep air from escaping bellowed cushioning device 130. A variety of different inflation mechanisms can be utilized in the present invention. Preferably, the inflation mechanism is small, lightweight, and provides a sufficient volume of air such that only little effort is needed for adequate inflation. For example, U.S. Pat. No. 5,987,779, which is incorporated herein by reference, describes an inflation mechanism comprising a bulb (of various shapes) with a check valve. When the bulb is compressed the check valve causes air within the volume of the bulb to be forced into the bellowed cushioning device 130. When the bulb is released, the check valve opens to allow ambient air to fill the bulb again.

Another inflation mechanism, also described in U.S. Pat. No. 5,987,779, is a bulb having a hole in it on top. A finger can be placed over the hole in the bulb upon compression. Therefore, air is not permitted to escape through the hole and is forced into the bellowed cushioning device 130. When the finger is removed, ambient air is allowed to enter through the hole. U.S. Pat. No. 6,287,225 describes another type of on-board inflation mechanism suitable for the present invention. One skilled in the art can appreciate that a variety of inflation mechanisms designed for use with athletic footwear would be suitable for the present invention. Similarly, various types of one-way valves are suitable for use along with the inflation mechanism 140. Preferably, the valve will be relatively small and flat, for less bulkiness. As one possible example, U.S. Pat. No. 5,564,143 to Pekar describes a valve suitable for the present invention. The patent describes a valve formed between thermoplastic polyurethane sheets, which is particularly thin and simple to manufacture. One skilled in the art would understand that a variety of suitable valves are contemplated in the present invention and that the example above is not intended to limit the type of valves that may be used herein.

As seen in FIGS. 1 and 2, shoe 100 further includes a deflation valve 142 disposed in upper 110 to enable air to be released. However, a deflation valve 142 is not required. The one-way valve used in conjunction with inflation mechanism 140 provides a method to avoid over inflation of the system. In particular, if the pressure in bellowed cushioning device 130 is equal to the pressure exerted by inflation mechanism 140, no additional air will be allowed to enter the system. In fact, when an equilibrium is reached between the pressure in bellowed cushioning device 130 and the pressure of the compressed inflation mechanism 140, the one-way valve which opens to allow air movement from inflation mechanism 140 to bellowed cushioning device 130 may remain closed. Even if this valve does open, no more air will enter the system. Any one-way valve will provide a similar effect, as would be known to one skilled in the art.

In another embodiment, small perforations may be formed in the outside surfaces of bellowed cushioning device 130 to allow air to naturally diffuse out of bellowed cushioning device 130 when a predetermined pressure is reached. The material used to make bellowed cushioning device 130 may be of a flexible material such that these perforations will generally remain closed. If the pressure in bellowed cushioning device 130 becomes greater than a predetermined pressure, the force on the outside surfaces of bellowed cushioning device 130 will open the perforations and air will escape. When the pressure in bellowed cushioning device 130 is less than this predetermined pressure, air will escape very slowly, if at all, from these perforations.

As an alternative, deflation valve 142 may be a check valve, or blow off valve, which will open when the pressure in bellowed cushioning device 130 is at or greater than a predetermined level. In each of these situations, bellowed cushioning device 130 will not inflate over a certain amount no matter how much a user attempts to inflate the shoe.

One type of check valve has a spring holding a movable seating member against an opening in bellowed cushioning device 130. When the pressure from the air inside the bladder causes a greater pressure on the movable seating member in one direction than the spring causes in the other direction, the movable seating member moves away from the opening allowing air to escape bellowed cushioning device 130. In addition, any other check valve is appropriate for use in the present invention, as would be apparent to one skilled in the art. As an example, the VA-3497 Umbrella Check Valve (Part No. VL1682-104) made of Silicone VL1001M12 and commercially available from Vernay Laboratories, Inc. (Yellow Springs, Ohio, USA) may be a preferred check valve. Further, any check valve would be appropriate for use in any embodiment of the present invention.

In another embodiment, deflation valve 142 may be a release valve. A release valve is useful to provide the wearer with a greater degree of control in varying the level of support and cushion of bellowed cushioning device 130. One release valve may be similar to the check valve described above, but capable of being adjusted by the user. For example, the valve may have a mechanism for increasing or decreasing the tension in the spring, such that more or less air pressure, respectively, would be required to overcome the force of the spring and move the movable seating member away from the opening in bellowed cushioning device 130. Another type of release valve is a plunger type valve. This type of valve also uses a spring to hold a seating member against a hole on the inside of bellowed cushioning device 130. A plunger type device is attached to the seating member, such that when the plunger is depressed the seating member is forced away from the hole to allow air to escape. As would be apparent to one skilled in the art, any type of release valve is appropriate for use in the present invention, as would be apparent to one skilled in the art, and any release valve would be appropriate for use in any embodiment of the present invention.

Bellowed cushioning device 130 may include more than one type of deflation valve 142. For example, bellowed cushioning device 130 may include both a check valve and a release valve. Alternatively, bellowed cushioning device 130 may contain a deflation valve 142 which is a combination release valve and check valve. The deflation valve 142 and inflation mechanism 140 may be molded as a unitary single piece as shown by the crossmarks 380 and 381 in piece 352 of FIG. 3.

Bellowed cushioning device 130 may be formed as a unitary structure. The entire structure may be blow molded or injection molded from a thermoplastic material. An injection molded or blow molded bellowed cushioning device 130 will likely be somewhat rigid. Another alternative is forming bellowed cushioning device 130 from a plurality of thin, flexible, durable thermoplastic sheets, such as a polyurethane film available from J.P. Stevens & Co., Inc., Northampton, Mass.

Figure 3:
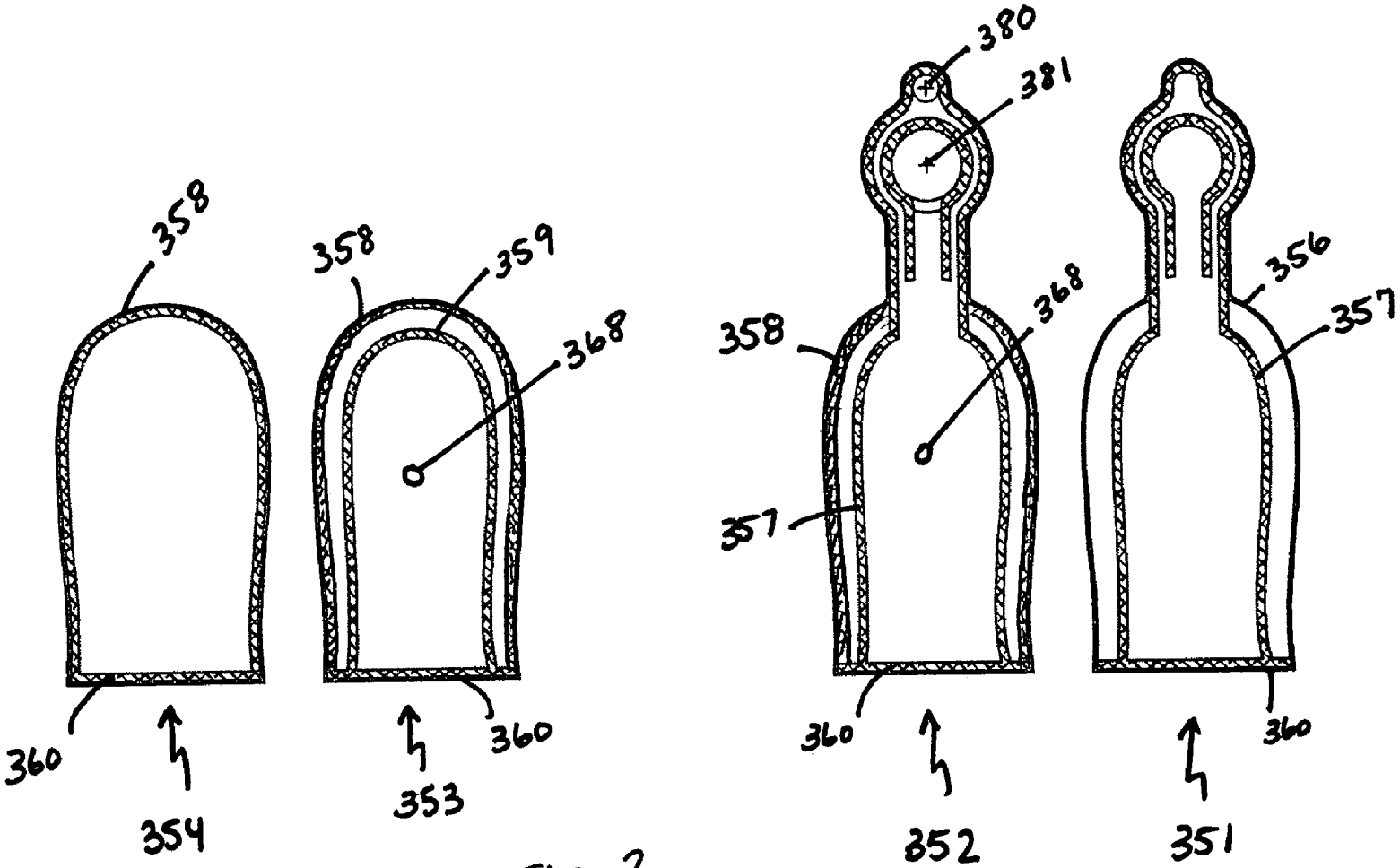
FIG. 3 is a top view of the sheets forming one embodiment of a cushioning device of the present invention.

In one embodiment, these thermoplastic sheets form a series of fluidly connected chambers that make up bellowed cushioning device 130. FIG. 3 shows how these sheets are die cut into particular shapes to form the bellowed cushioning device 130. As shown in FIG. 3, bellowed cushioning device 130 may be formed of a first sheet 351, a second sheet 352, a plurality of third sheets 353, and a fourth sheet. The first sheet 351 and the fourth sheet 354, in this case, make up first and second generally flat surfaces 510, 511 (see FIG. 5) for bellowed cushioning device 130, while second sheet 352 and each of third sheets 353 make up the bellowed surface 132. However, any number of third sheets 353 can be added to form a bellowed surface 132 of a larger size.

In one embodiment, the sheets are attached to each other by welding. In a most preferred embodiment, the sheets are attached to each other by radio frequency welding. However, the sheets may be attached by heat welding, ultrasonic welding or any other means for securing thermoplastic sheets together in an airtight manner.

Figure 4:
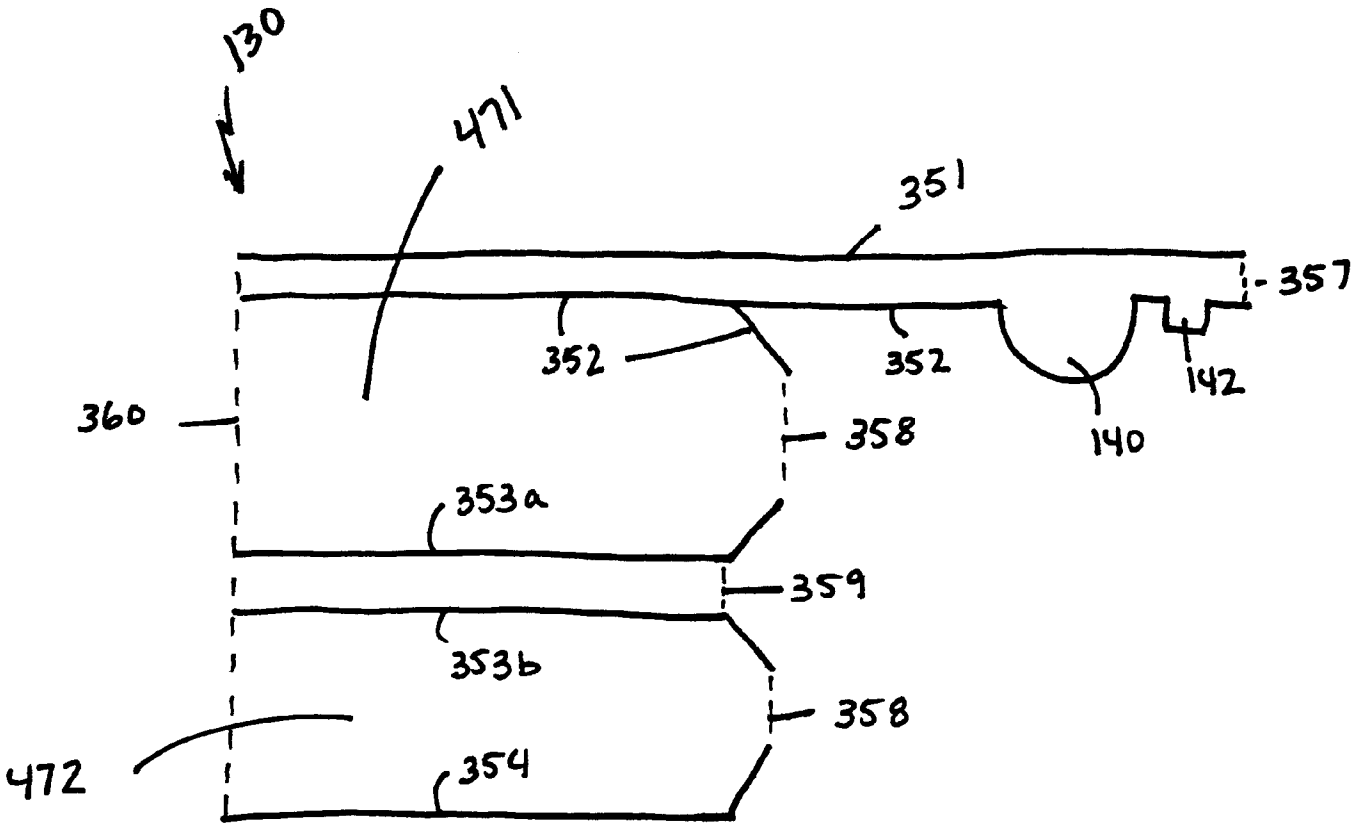
FIG. 4 is an exploded cross section view of a cushioning device of the present invention made from the sheets of FIG. 3.

FIG. 4. is an exploded cross section view of bellowed cushioning device 130, which shows how sheets 351, 352, 353 and 354 are attached. First and second sheets 351 and 352, as seen in FIG. 3, are attached along weld line 357. First and second sheets 351, 352 are attached to form the fluid connection between the inflation mechanism located, in this embodiment, at cross mark 381 and deflation valve located, in this embodiment, at cross mark 380. Outer edge 356 of first sheet 351 is not welded to any other sheet in order to firmly secure a generally flat surface 510 (see FIG. 5) of bellow cushioning device 130 to other parts of shoe 100.

Second sheet 352 is also attached to third sheet 353*a* along an outer weld line 358 to form a first chamber 471. Third sheet 353*a* is then attached to sheet 353*b*, which is identical to sheet 353*a*, along an inner weld line 359. A second chamber 472 is formed when the sheet 353*b* is attached to a fourth sheet 354 along an outer weld line 358. To form the air tight bellows-like shape of bellowed cushioning device 130, all sheets are attached together along common bottom weld line 360. Fourth sheet 354 is not attached to any other sheet to form a second generally flat surface 511 (see FIG. 5).

One skilled in the art would understand that the distance between inner weld lines 359 and outer weld line 359 can be any length provided that they are uniform throughout each third sheet 353.

Chambers 471 and 472 of FIG. 4 are fluidly interconnected through at least one hole 368 (FIG. 3) between each chamber formed in sheets 352 and 353. Sheets 351 and 354 do not have these holes because they act as generally flat top and bottom surfaces 510, 511 (see FIG. 5) of air tight bellow cushioning device 130. In an alternative embodiment, only sheets 351 and 354 are welded to each other along bottom weld line 369. In this embodiment, air is allowed to fluidly move throughout the chambers at the common straight end of bellows cushioning device 130. In this embodiment, second and third sheets 352 and 353 may be slightly shorter than first and fourth sheets 351 and 354, provided that they still have a similar overall shape. In this embodiment, holes 368 may or may not be found in each second and third sheets 352, 353.

Figure 5:
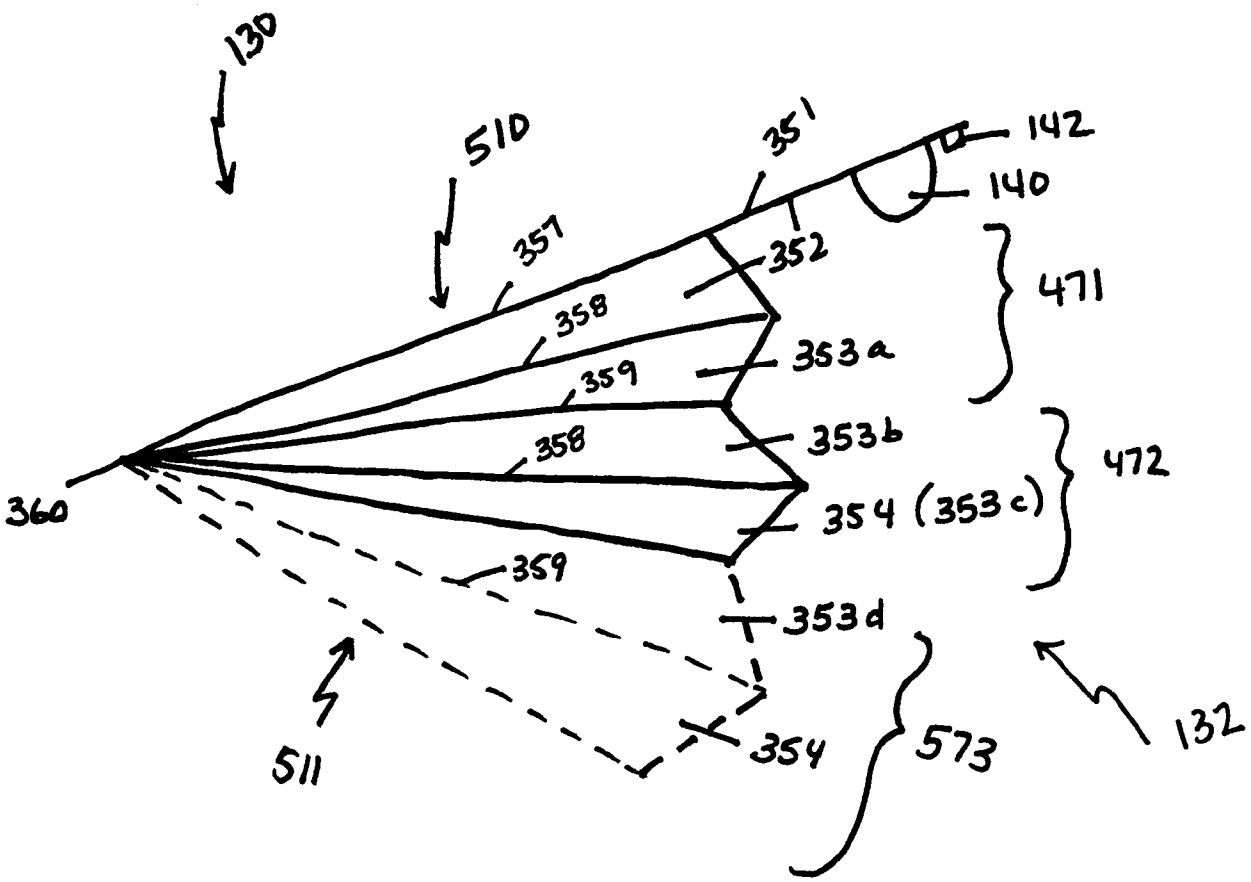
FIG. 5 is a side view of a cushioning device of the present invention formed from the sheets of FIG. 3 constructed as in FIG. 4.

FIG. 5 shows a side view of bellowed cushioning device 130. Alternatively, additional chambers, such as optional chamber 573 can be added by attaching two additional third sheets 353*c* and 353*d* in the same manner described above, and as is shown by the dotted lines in FIG. 5. It would be obvious to one skilled in the art how to form any number of optional chambers to the bellow cushioning area by the addition of sheets identical to 354*a*, 354*b*, and 355 (such as sheets 354*c*, 354*d* and 355*e* in FIG. 4) between sheet 355 and sheet 356. One skilled in the art would understand that the addition of such chambers, however, increases the total volume of the bellow cushioning device 130.

As seen in FIG. 5, bellowed cushioning device 130 is wedge shaped such that bellowed surface 132 decreases in height along its length. In alternate embodiments, bellowed cushioning device 130 may be other shapes, as would be apparent to one skilled in the art, provided that it has at least one bellowed surface 132.

Figure 6:
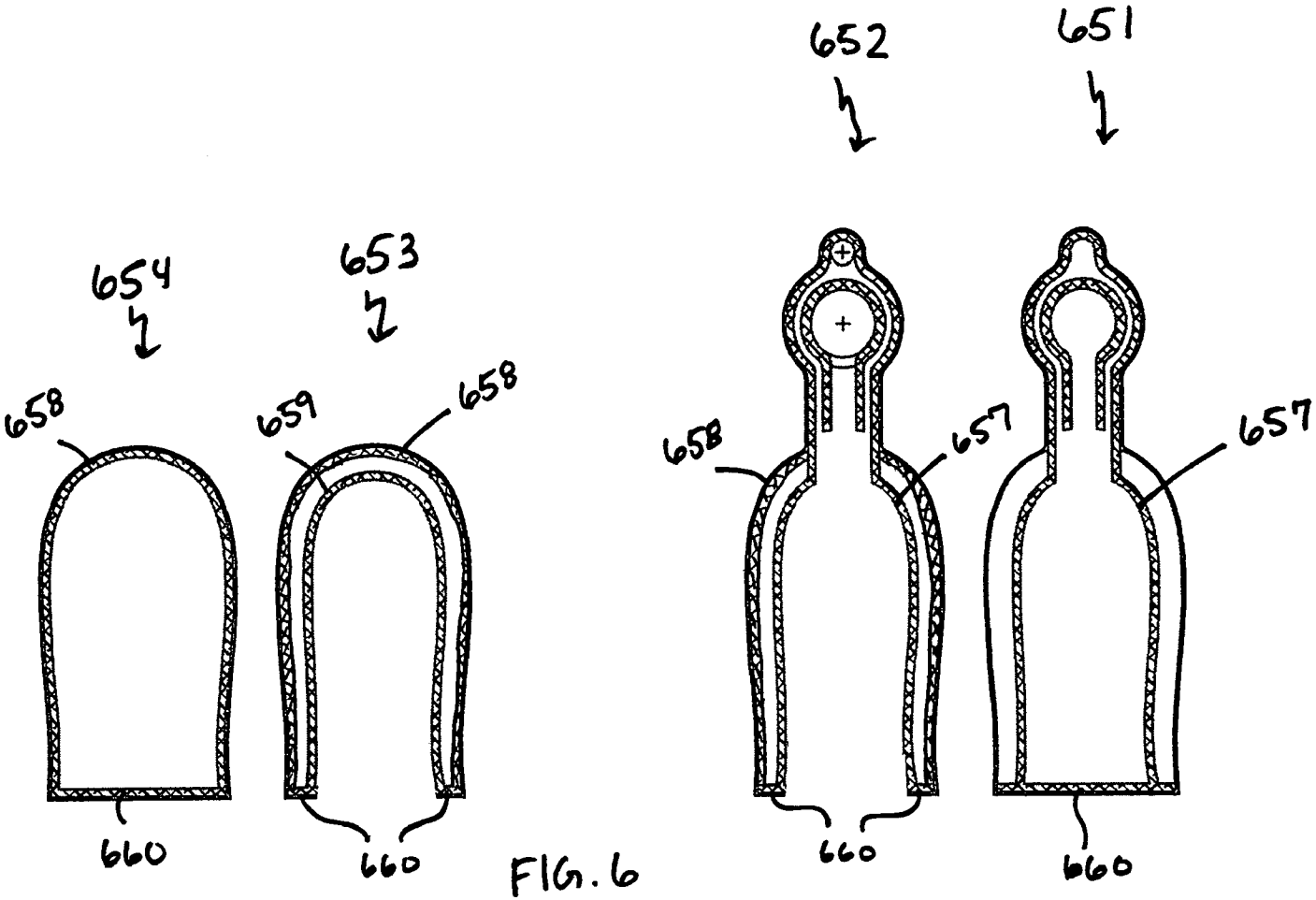
FIG. 6 is a top view of the sheets forming another embodiment of a cushioning device of the present invention.
Figure 7:
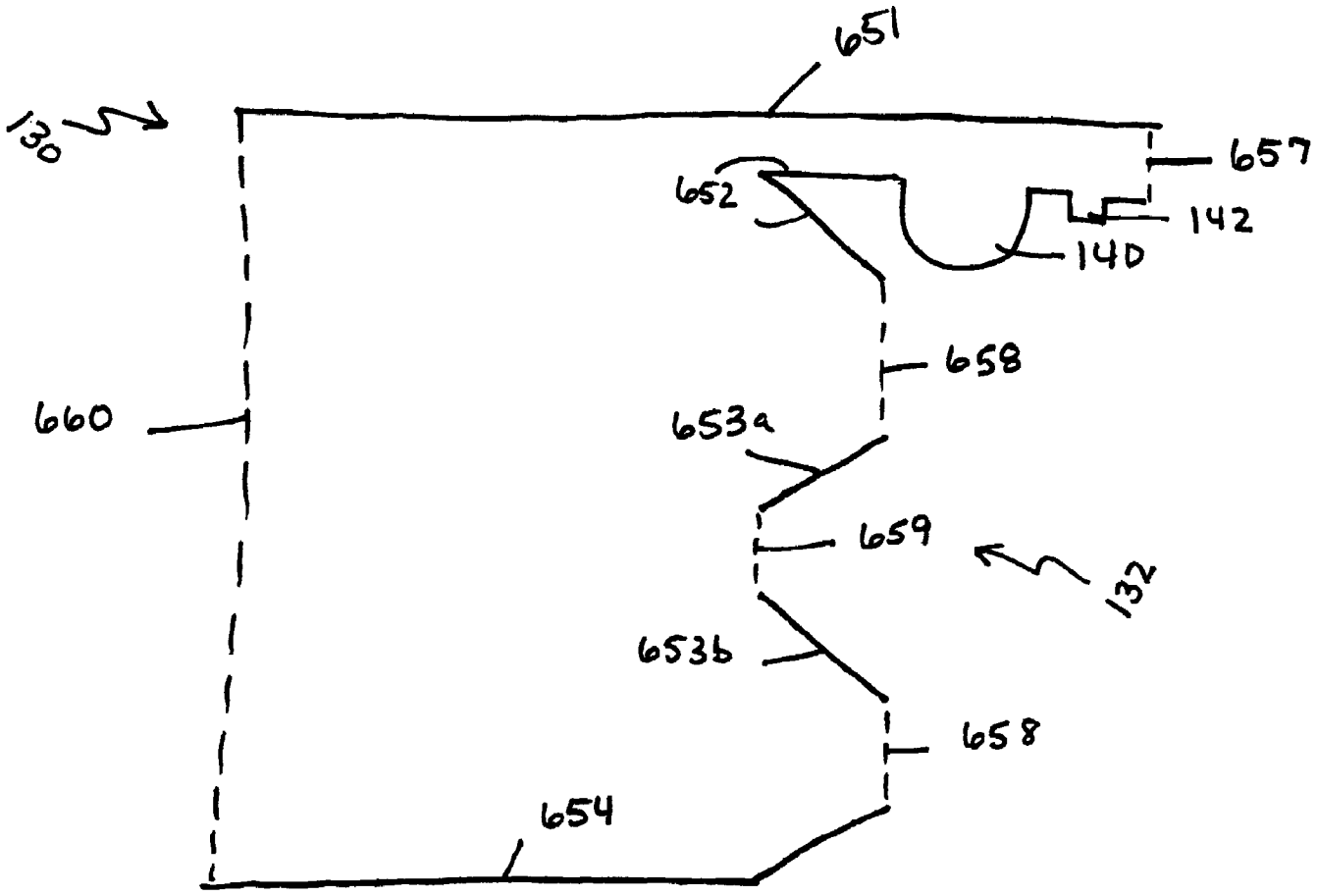
FIG. 7 is an exploded cross section view of a cushioning device of the present invention made from the sheets of FIG. 6.

Another embodiment is described with respect to FIGS. 6 and 7. FIG. 6 shows that bellowed cushioning device 130 can be formed with traditional first sheet 651, horseshoe-shaped second sheet 652, a plurality of horseshoe-shaped sheets 653, and a traditional forth sheet 654. FIG. 7 is an exploded cross section view of bellowed cushioning device 130, which shows how sheets 651, 652, 653 and 654 are attached. First sheet 651 and horseshoe-shaped second sheet 652, as seen in FIG. 6, are attached along weld line 657, similar to the earlier described embodiment. Horseshoe-shaped second sheet 652 is also attached to horseshoe-shaped third sheet 653*a* along an outer weld line 658. Third sheet 653*a* is then attached to another horseshoe-shaped sheet 653*b*, which is identical to sheet 653*a*, along an inner weld line 659. Then, horseshoe-shaped sheet 653*b* is attached to a fourth sheet 654 along an outer weld line 658. To form the air tight bellows-like shape of bellowed cushioning device 130, all sheets are attached together along common bottom weld line 660. This alternative embodiment forms one large cavity 771, rather than a plurality of chambers.

As air enters bellowed cushioning device 130, its volume will increase. A natural-state volume, therefore, is initially determined by the amount of air pumped into the bellowed cushioning device 130. The natural-state volume of the shoe will provide lift to the wearer when standing. This lift may also provide a height advantage to the wearer.

As the foot exerts downward pressure on bellowed cushioning device 130, the bellowed surface 132 collapses upon itself, to cushion the foot from the force of this pressure. As this happens the air in bellowed cushioning device 130 compresses, increasing the pressure of the air and decreasing the volume of bellowed cushioning device 130 to a compressed-state volume. However, the compressed air will not allow bellowed cushioning device 130 to completely collapse, thus providing support to the foot with each step. As the foot begins to rise, the pressure of the air expands the volume of bellowed cushioning device 130 back to its natural-state. The release of energy caused by the expansion of air is returned to the foot as bellowed cushioning device 130 springs from its compressed-state volume to its natural-state volume.

Even when bellowed cushioning device 130 is not inflated, the bellowed configuration is resilient enough to provide a sufficient volume so that bellowed surface 132 will collapse with the downward pressure from a typical step. Therefore, the foot is cushioned by the resiliency of bellowed cushioning device 130 even when it only contains air at ambient pressure.

Although bellowed cushioning device 130 is shown in FIGS. 1 and 2 being located in the heel area of the shoe, in alternate embodiments bellowed cushioning device 130 may be located anywhere in shoe 100, particularly under the forefoot or arch of a wearer's foot or in the upper.

Bellowed cushioning device 130 of the embodiments shown in FIGS. 1 and 2 is located between an upper 110 and a sole 120. In other embodiments, bellowed cushioning device 130 may also be located within a split in a midsole 870, as shown in shoe 800 of FIG. 8, or in a recess formed within midsole 870. Bellowed cushioning device 130 may also be located between and upper 110 and midsole 870 or between a midsole and an outsole 872 of a sole 120. Sole 120 may instead have a thermoformed footplate, as an alternative to a midsole 870, to which upper 110 is adhered. In this embodiment, bellowed cushioning device 130 may be located between upper 110 and the footplate or between the footplate and outsole 872. Bellowed cushioning device 130 may even be inserted into a conventional shoe. The bellowed cushioning device 130 may therefore be located in any other position, as would be apparent to one skilled in the art.

Figure 8:
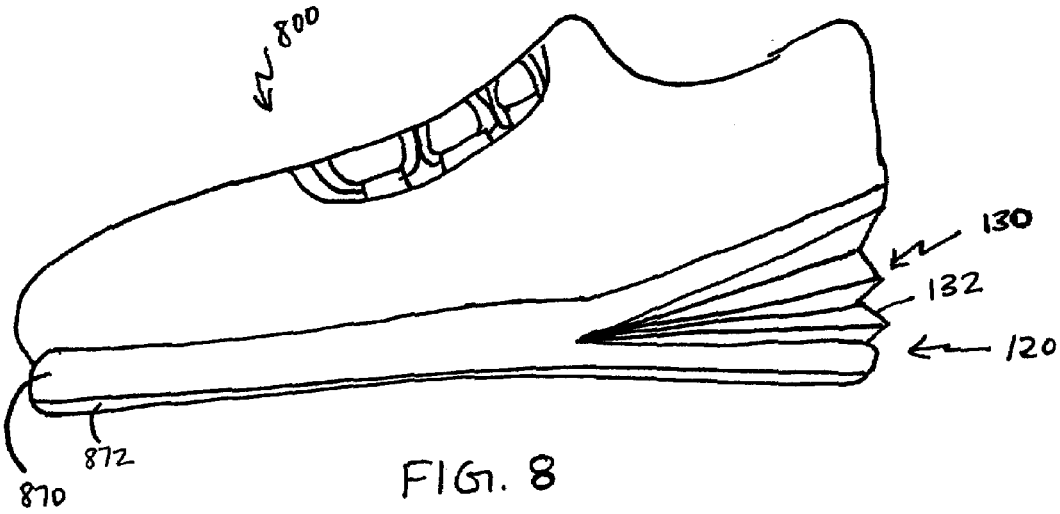
FIG. 8 is a side view of another shoe including an inflated cushioning device of the present invention.

Bellowed cushioning device 130 may be located entirely within the interior of sole 120 or upper 110, or bellowed cushioning device 130 may have at least its bellowed surface 132 as part of the exterior of a shoe or sole 120 thereof, as shown in FIGS. 1, 2 and 8.

While the invention has been particularly shown and described with reference to preferred embodiments thereof, it will be understood by those skilled in the art that they have been presented by way of example only, and not limitation, and various changes in form and details can be made therein without departing from the spirit and scope of the invention. Thus, the breadth and scope of the present invention should not be limited by any of the above-described exemplary embodiments, but should be defined only in accordance with the following claims and their equivalents. Additionally, all references cited herein, including issued U.S. patents, or any other references, are each entirely incorporated by reference herein, including all data, tables, figures, and text presented in the cited references.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. An inflatable cushioning device for an article of footwear, comprising:

a first generally flat surface attached to a portion of the article of footwear;

a second generally flat surface;

at least one bellowed surface between said first flat surface and said second flat surface, wherein said first flat surface, said second flat surface, and said bellowed surface form a fluid-tight, enclosed area and wherein said bellowed surface will collapse when a force is applied;

wherein said enclosed area is defined by four or more sheets, each of said sheets extending between a first end and a second end of said enclosed area and allowing fluid communication within the entire volume of said enclosed area; and an inflation mechanism in fluid communication with the entire volume of said enclosed area for selectively introducing air into said enclosed area.

2. The cushioning device of claim 1, wherein said inflatable cushioning device is generally wedge shaped, such that said first and second generally flat surfaces are in close proximity at said first end and are separated by said bellowed surface at said second end.

3. The cushioning device of claim 1, wherein said four or more fluid impervious sheets comprises a first sheet, a second sheet, a third sheet and a fourth sheet;

wherein said first sheet is said first generally flat surface and is attached to said second sheet, said second sheet is attached to said third sheet, and said third sheet is attached to said fourth sheet, said fourth sheet being said second generally flat surface, wherein said sheets other than said first and fourth sheets form said bellowed surface.

4. The cushioning device of claim 3, wherein all but the first and fourth sheets are horseshoe shaped, such that said enclosed area comprises a single large cavity.

5. The cushioning device of claim 3, wherein said enclosed area comprises a plurality of chambers, wherein said first sheet and said second sheet form a first chamber, said third sheet and said forth sheet form a second chamber.

6. The cushioning device of claim 5, wherein said plurality of chambers are fluidly connected through at least one hole in all but the first and fourth sheets.

7. The cushioning device of claim 1, wherein said sheets are made from thermoplastic polyurethane.

8. The cushioning device of claim 1, further comprising a deflation mechanism.

9. An article of footwear, comprising:

an upper, a sole, an inflatable cushioning device, said inflatable cushioning device having a first generally flat surface attached to a portion of the article of footwear, a second generally flat surface, at least one bellowed surface located between said first and second generally flat surfaces, wherein said first flat surface, said second flat surface and said bellowed surface form an enclosed, air-tight area and wherein said bellowed surface will collapse when a force is applied, wherein said enclosed area is defined by four or more sheets, each of said sheets extending between a first end and a second end of said enclosed area and allowing fluid communication within the entire volume of said enclosed area; and an inflation mechanism in fluid communication with the entire volume of said enclosed area for selectively introducing air into said cushioning device.

10. The article of footwear of claim 9, wherein said cushioning device is generally wedge shaped, such that said first and second generally flat surfaces are in close proximity at said first end and are separated by said bellowed surface at said second end.

11. The article of footwear of claim 9, wherein said cushioning device is located substantially under the foot, whereby the impact of the foot against the ground is cushioned with each step.

12. The article of footwear of claim 9, wherein said cushioning device is disposed within said sole.

13. The article of footwear of claim 12, wherein said cushioning device is disposed within a midsole.

14. The article of footwear of claim 12, wherein said cushioning device is disposed between a midsole and a outsole.

15. The article of footwear of claim 9, wherein said cushioning device is disposed between a sole and an upper.

16. The article of footwear of claim 9, wherein said bellowed surface is visible from the exterior of said article of footwear.

17. The article of footwear of claim 9, wherein said cushioning device includes a deflation mechanism.

18. A process for manufacturing a bellowed cushioning device for an article of footwear comprising:

providing four or more sheets;

attaching said sheets together to form a first generally flat surface, a second generally flat surface and a bellowed surface defining a fluid-tight enclosed area, wherein each of said sheets extends between a first end and a second end of said enclosed area and allows fluid communication within the entire volume of said enclosed area; and attaching said first generally flat surface to a portion of the article of footwear.

19. The process according to claim 18, further comprising the step of providing an inflation mechanism in fluid communication with the entire volume of said enclosed area for selectively introducing air into said enclosed area.

20. The process according to claim 18, wherein said four or more sheets comprises at least a first sheet, a second sheet, a third sheet, and a fourth sheet, further comprising:

attaching at least a portion of said first sheet to at least a portion of said second sheet along a first outer weld line;

attaching at least a portion of said second sheet to at least a portion of said third sheet along an inner weld line;

attaching at least a portion of said third sheet to at least a portion of said fourth sheet along an outer weld line;

wherein said second sheet and said third sheet form said bellowed surface.

* * * * *